US009689123B2

(12) United States Patent
Chi

(10) Patent No.: US 9,689,123 B2
(45) Date of Patent: Jun. 27, 2017

(54) SAFETY WARNING DEVICE

(71) Applicant: Tien Sheng Chi, Taichung (TW)

(72) Inventor: Tien Sheng Chi, Taichung (TW)

( * ) Notice: Subject to any disclaimer, the term of this patent is extended or adjusted under 35 U.S.C. 154(b) by 116 days.

(21) Appl. No.: 14/721,209

(22) Filed: May 26, 2015

(65) Prior Publication Data

US 2016/0348325 A1 Dec. 1, 2016

(51) Int. Cl.
*E01F 9/654* (2016.01)
*A63K 3/00* (2006.01)

(52) U.S. Cl.
CPC ..... *E01F 9/654* (2016.02); *A63K 3/00* (2013.01)

(58) Field of Classification Search
CPC ..... E01F 9/654; A63K 3/00
USPC ..... 116/63 C, 63 P, 63 T, 28 R, 173, 200
See application file for complete search history.

(56) References Cited

U.S. PATENT DOCUMENTS 2,275,711 A * 3/1942 Ybanez ..... E01F 9/654 116/63 C
2,762,327 A * 9/1956 Weig ..... E01F 9/654 116/63 C
2,954,005 A * 9/1960 Cioffi ..... E01F 9/654 116/63 C
3,099,244 A * 7/1963 Knapp ..... E01F 9/654 116/63 C
3,496,904 A * 2/1970 Rimkus ..... E01F 9/654 116/63 C
4,006,702 A * 2/1977 St. Cyr ..... E01F 9/688 116/63 P
4,197,807 A * 4/1980 Campbell ..... E01F 9/654 116/63 P
4,256,050 A * 3/1981 Barnard ..... B60Q 7/005 116/63 C
4,973,189 A * 11/1990 Bechtold ..... E01F 13/02 206/1.5
5,199,813 A * 4/1993 Nagler ..... E01F 9/654 404/10
5,305,705 A * 4/1994 Gagliano ..... E01F 9/654 116/63 P
6,338,311 B1 * 1/2002 Ho ..... E01F 9/654 116/63 C
7,056,055 B1 * 6/2006 Kuo ..... E01F 9/654 116/63 C
7,228,813 B2 * 6/2007 Flamingo ..... E01F 9/654 116/63 C
7,338,229 B1 * 3/2008 Kuo ..... E01F 9/654 116/63 C
7,677,831 B2 * 3/2010 Kulp ..... E01F 9/654 116/63 C
D617,402 S * 6/2010 Fuccillo ..... D10/113.2
7,811,026 B1 * 10/2010 Kulp ..... E01F 9/654 116/63 C
9,493,919 B2 * 11/2016 Handy ..... E01F 9/688
(Continued)

*Primary Examiner* — R. A. Smith
*Assistant Examiner* — Tania Courson
(74) *Attorney, Agent, or Firm* — Chun-Ming Shih

(57) ABSTRACT

A safety warning device includes an integrally formed telescopic warning body which is a flexible bellows-shaped tube having a bottom end, a top end, and a bellows section connecting the top end and the bottom end. As a result, the telescopic warning body can be compressed and elongated by an external force, thereby minimizing the volume and facilitating the moving of the safety warning device, as well as achieving the goal of extending the usage life and having better safety.

8 Claims, 12 Drawing Sheets

(56) References Cited

U.S. PATENT DOCUMENTS

| | | | | |
|---|---|---|---|---|
| 2004/0237875 | A1* | 12/2004 | Garcia | E01F 9/688<br>116/63 C |
| 2006/0219153 | A1* | 10/2006 | Tipaldo | E01F 9/654<br>116/63 C |

* cited by examiner

SAFETY WARNING DEVICE

BACKGROUND

1. Technical Field

The technical field relates to a warning device, particularly to a safety warning device.

2. Related Art

When a road is under construction or maintenance, one or more traffic warning devices (also known as traffic cone, warning cone, safety cone, etc.) will be placed on a significant position of the ground to block the dangerous pathway and warn the pedestrians to detour, so as to lower the chance of causing traffic accident.

However, the conventional traffic warning device (also known as traffic cone, warning cone, safety cone, etc.) is usually integrally made of hard plastic, and the main structure of the traffic warning device includes a square-shaped base and a conical body, the conical body integrally extends from the base, and the outer diameter of the conical body is eventually narrowed down to form a conical shape. Even though this kind of traffic warning device can be stacked, however, the actual volume of this traffic warning device remains unchanged. Therefore, this traffic warning device not only takes a lot of space in storage, but also causes inconvenience in moving. Besides, since the conventional traffic warning device is hard and solid, injury or damage might be caused to the users and the traffic warning device itself when the users hit the conventional traffic warning device.

Moreover, when doing the skateboarding and in-line skating, people usually place a plurality of traffic cone in interval as an indication for the exercise training. When user hits the traffic cone, the hard material of the conventional traffic cone might hurt the user or make the user uncomfortable.

BRIEF SUMMARY

In order to improve the drawbacks of bulky size, space occupancy, moving inconvenience, easy to be damaged, and harmful to the users safety of the conventional technique, an exemplary embodiment of the present invention provides a safety warning device, which includes: a telescopic warning body integrally formed with a flexible bellows-shaped tube (as known as flexible corrugated tube), the flexible bellows-shaped tube has a bottom end, a top end, and a bellows section (as known as corrugated section) connected between the bottom end and the top end. Thus, the telescopic warning body is able to be compressed and elongated under external force The aforementioned safety warning device, further includes a base; a connecting flange is formed at the bottom end toward an axle of the telescopic warning body; the base has a base plate and a connecting ring seat; the base plate has a bottom surface and a top surface being on an opposite side of the bottom surface; the connecting ring seat is integrally connected to the top surface of the base plate; an outer periphery of the connecting ring seat concavely forms a connecting ring trough and an inserting trough communicating the connecting ring trough and a top surface of the connecting ring seat; the inserting trough inclinedly corresponds to an axle of the connecting ring seat; the connecting flange of the telescopic warning body slides along the inserting trough of the base to slide into the connecting ring trough and rotates a circle along the connecting ring trough, so as to connect the connecting flange of the telescopic warning body to the connecting ring trough of the base.

The aforementioned safety warning device further includes an elongated connecting ring and an elongated telescopic warning body; an outer periphery of the elongated connecting ring concavely forms a bottom connecting ring trough, a bottom inserting trough communicating the bottom connecting ring trough and one end of the elongated connecting ring; the outer periphery of the elongated connecting ring also concavely forms a top connecting ring trough and a top inserting trough communicating the top connecting ring trough and another end of the elongated connecting ring; the bottom inserting trough inclinedly corresponds to an axle of the elongated connecting ring; the top inserting trough inclinedly corresponds to the axle of the elongated connecting ring; the elongated telescopic warning body is integrally formed as the flexible bellows-shaped tube; the elongated flexible bellows-shaped tube has an elongated bottom end, an elongated top end, and an elongated bellows section connected between the elongated bottom end and the elongated top end; a bottom connecting flange is formed at the elongated bottom end toward an axle of the elongated telescopic warning body, a top connecting flange is formed at the elongated top end toward the axle of the telescopic warning body; the top connecting flange of the telescopic warning body slides along the bottom inserting trough of the elongated connecting ring and slides into the bottom connecting trough to rotate a circle along the bottom connecting trough, so as to connect the top connecting flange of the telescopic warning body to the bottom connecting ring trough of the elongated connecting ring; the bottom connecting flange of the elongated telescopic warning body slides along the top inserting trough of the elongated connecting ring and slides into the top connecting trough to rotate a circle along the top connecting trough, so as to connect the bottom connecting flange of the elongated telescopic warning body to the top connecting ring trough of the elongated connecting ring.

The aforementioned safety warning device, wherein the elongated connecting ring is integrally formed and has a bottom connecting part, a top connecting part, and a middle connecting part connecting the bottom connecting part and the top connecting part; an outer diameter of the middle connecting part is larger than that of the bottom connecting part and the top connecting part; the bottom connecting ring trough and the bottom inserting trough are formed on an outer peripheral surface of the bottom connecting part; the top connecting ring trough and the top inserting trough are formed on an outer peripheral surface of the top connecting part.

When an external force is applied to the telescopic warning body of the preferred embodiment of the present invention, the bellows section will be compressed to shorten the length thereof, which can further largely reduce the volume and the space occupied, and also save efforts of moving. Moreover, the telescopic warning body is flexible, which is not easy to be damaged under collision, and thus the usage life can be prolonged as well. Also, due to the flexible characteristic, the injury and damage to the users and vehicles caused by telescopic warning body can be minimized, thereby achieving the goals of small storage volume, easy moving, long usage life, and superior safety.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
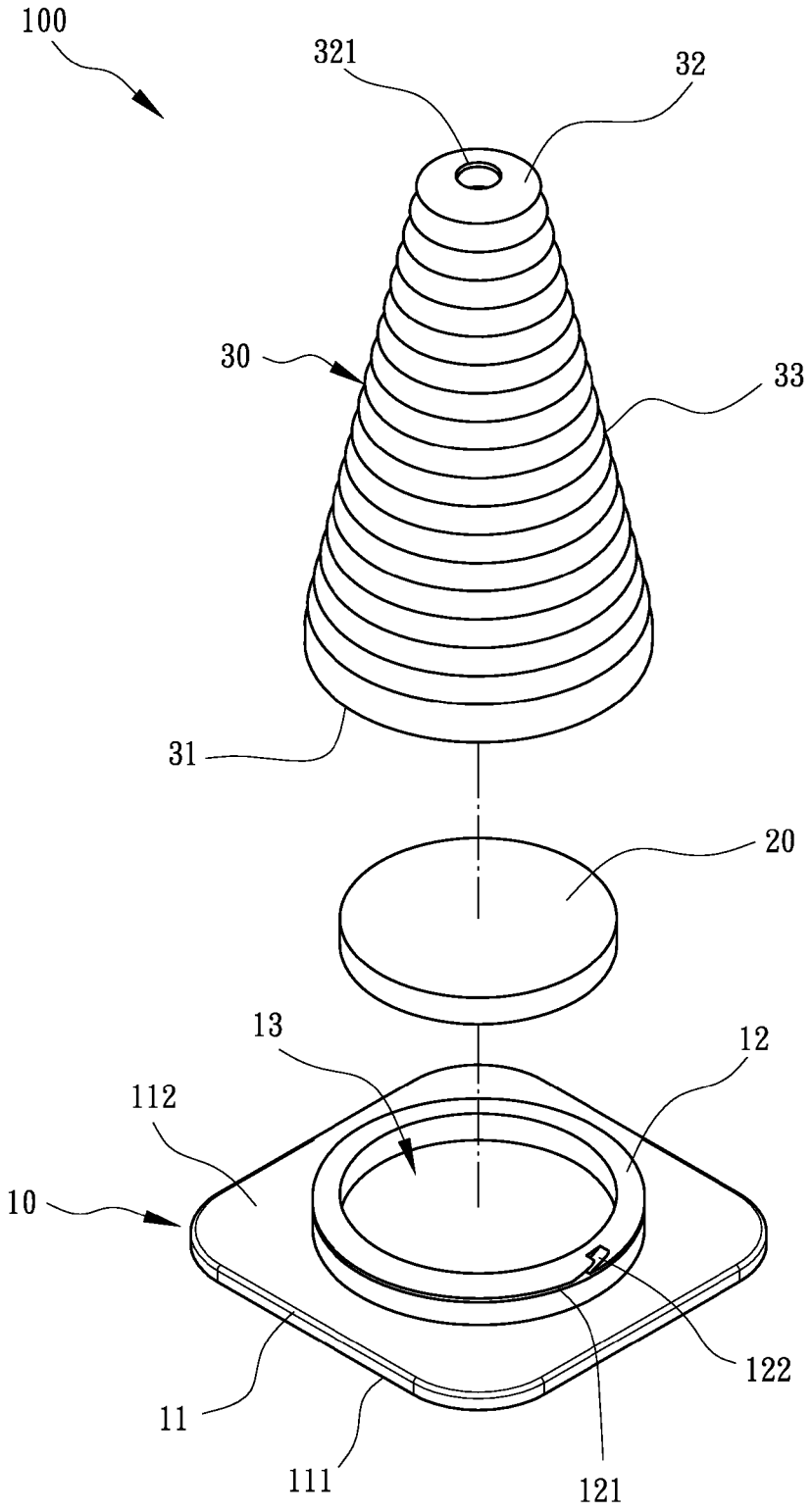
FIG. 1 is an exploded perspective view of a first preferred embodiment of the present invention.
Figure 2:
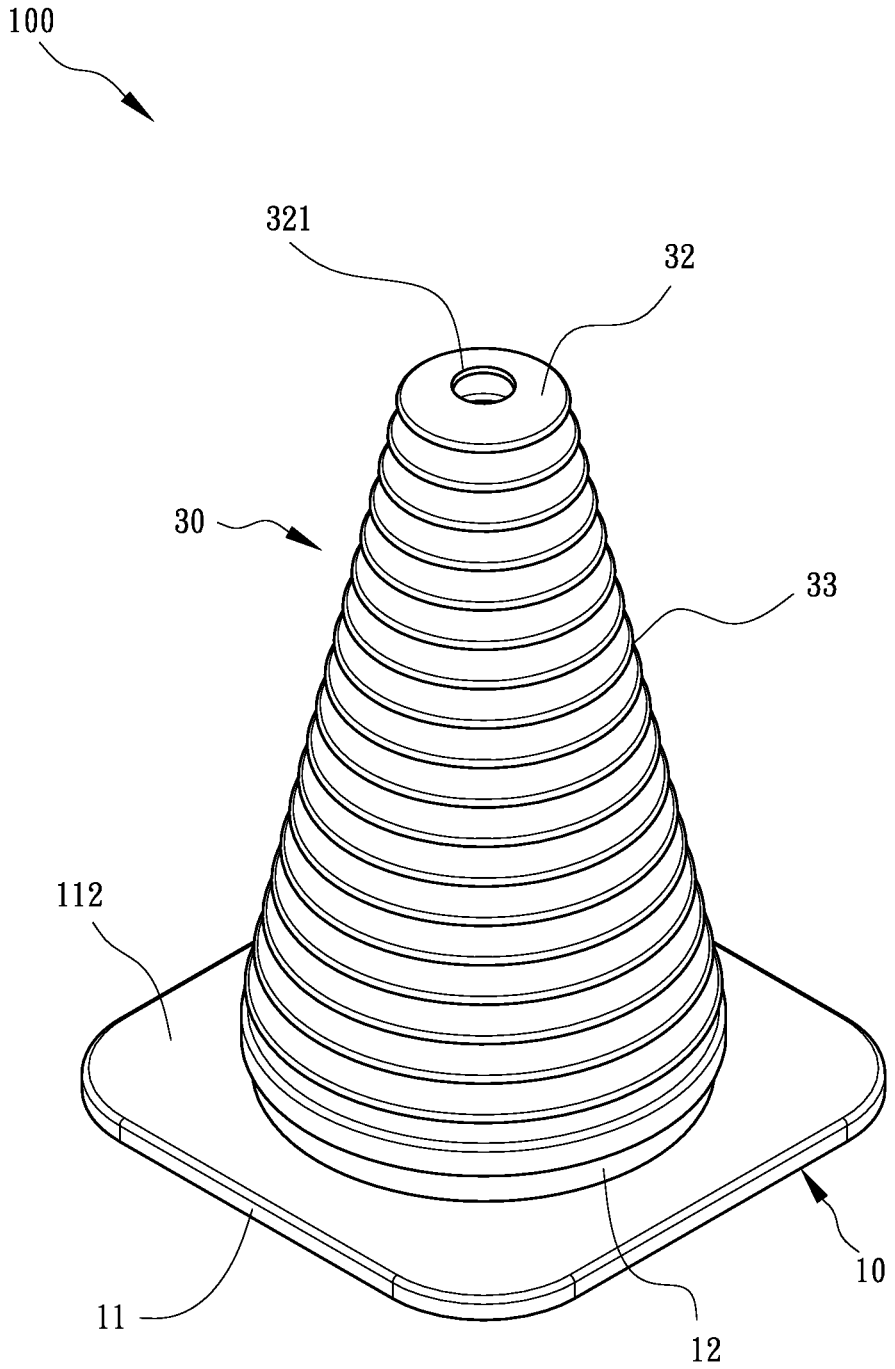
FIG. 2 is a three-dimensional assembly diagram of FIG. 1.
Figure 3:
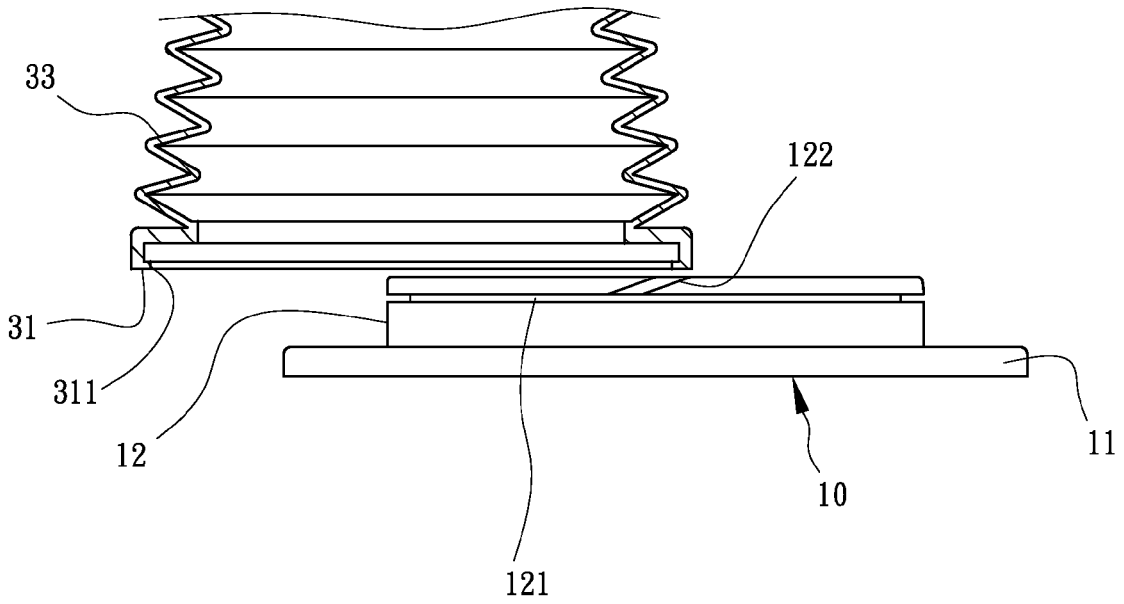
FIG. 3 is a schematic diagram showing the assembling process of FIG. 1.

Please refer to FIGS. 1-5, one of the preferred embodiments of the safety warning device 100 of the present invention includes a base 10, a counterweight block 20, and a telescopic warning body 30.

Please refer to FIGS. 1-4, the base 10 has a base plate 11 and a connecting ring seat 12. The base plate 11 is a chamfered square-shaped plate having a bottom surface 111 and a top surface 112 opposite to the bottom surface 111. The bottom surface 111 can be steadily placed on the ground (or flat surface). The connecting ring seat 12 is a round-shaped ring, which is integrally disposed on the top surface 112 of the base plate 11. Thus, an accommodating space 13 with a hollow top is formed by surrounding of the connecting ring seat 12 and the top surface 112 of the base plate 11. An outer periphery of the connecting ring seat 12 concavely forms a connecting ring trough 121 and an inserting trough 122 communicating the connecting ring trough 121 and a top surface of the connecting ring seat 12. The inserting trough 122 inclinedly corresponds to an axle of the connecting ring seat 12.

Please refer to FIGS. 1-4, the counterweight block 20 has a predetermined weight, and the outer profile of the counterweight 20 is identical to the outer profile of the accommodating space 13 of the base 10. The counterweight block 20 is made of metal, stone powder, or sand.

Please refer to FIGS. 1-4, the telescopic warning body 30 is integrally formed as a flexible bellows-shaped tube, which is in conical shape. The telescopic warning body 30 can be compressed or elongated by an external force. When an external force is applied, the telescopic warning body 30 can be compressed; when the external force is released, the telescopic warning body 30 will be back to the original condition. The telescopic warning body 30 has a bottom end 31, a top end 32, and a bellows section 33 connected between the bottom end 31 and the top end 32. The outer diameter of the bottom end 31 is larger than that of the top end 32. The outer diameter of the bellows section 33 at the bottom end 31 eventually narrows down toward the top end 32. A connecting flange 311 is formed at the bottom end 31 toward an axle of the telescopic warning body 30. A through hole 321 communicating outside and inside is formed at the center of the top end 32.

The aforementioned is the first preferred embodiment of the safety warning device 100 according to the present invention. The detailed assembling method and the way of using are described below.

Figure 4:
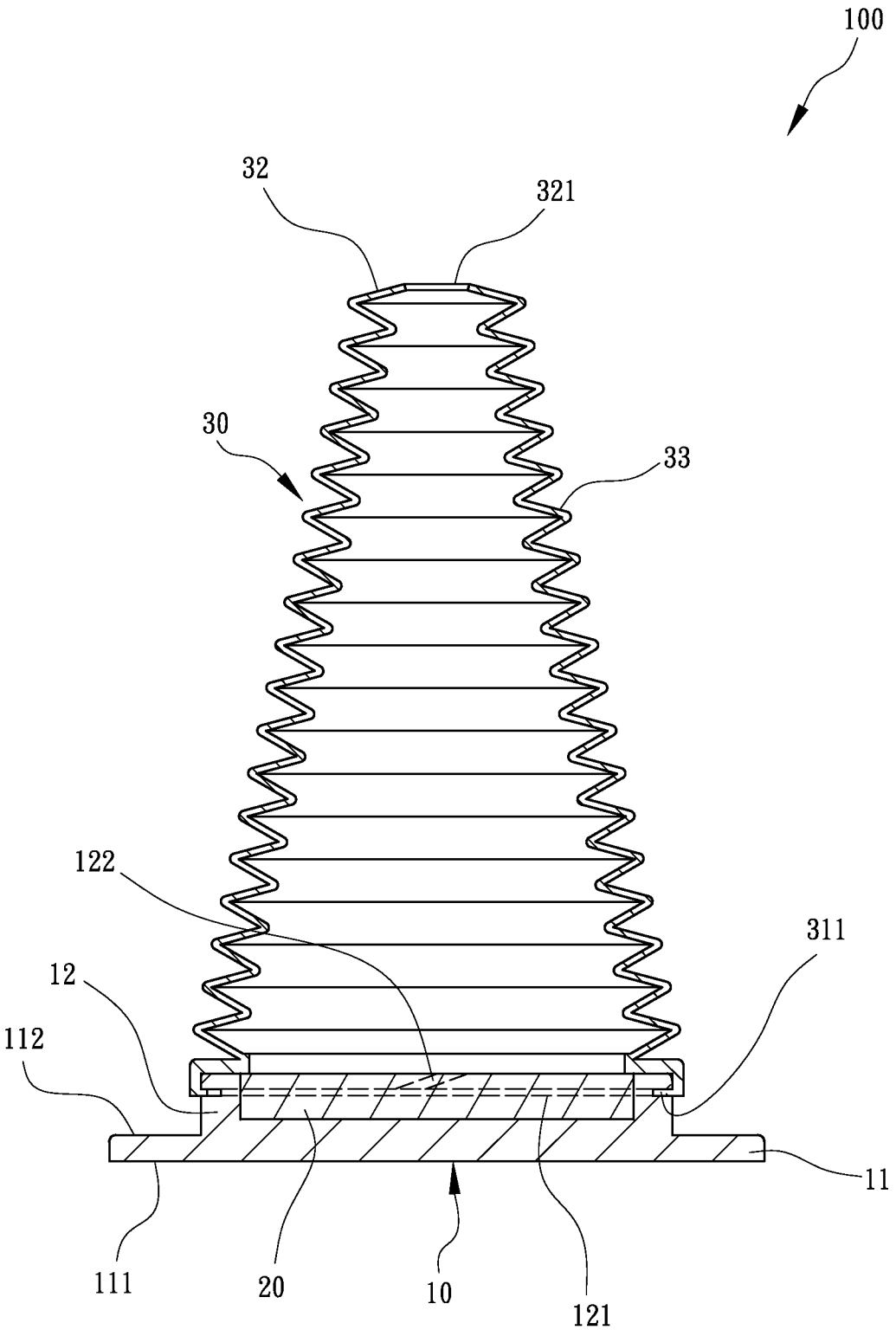
FIG. 4 is an assembled sectional view of FIG. 1.

When a user wants to use the safety warning device 100, a counterweight block 20 is steadily disposed inside the accommodating space 13 of the base 10, and then the connecting flange 311 on the bottom end 31 of the telescopic warning body 30 slides along the inserting trough 122 of the base 10 into the connecting ring trough 121 and rotates a circle along the connecting ring trough 121. Thus, the connecting flange 311 of the telescopic warning body 30 can be connected to the connecting ring trough 121 of the base 10 (as shown in FIG. 4) to complete the assembling process of the exemplary embodiment of the present invention.

Figure 5A:
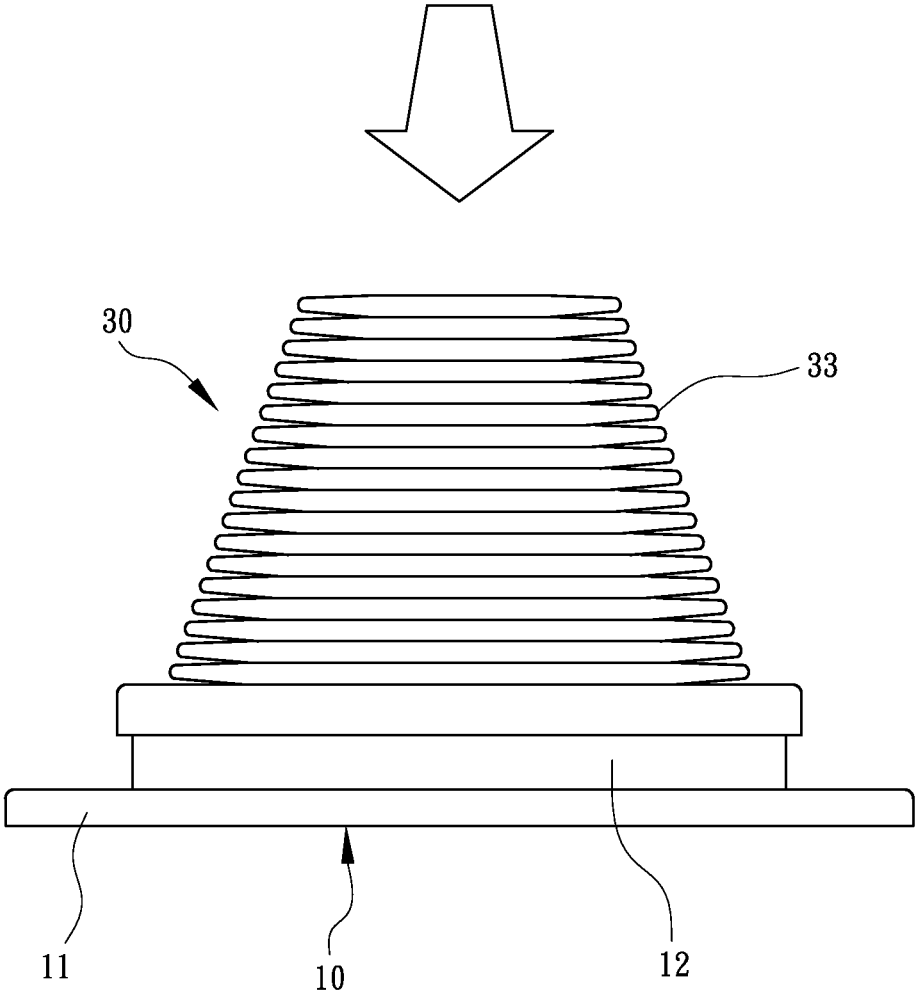
FIG. 5A is a schematic diagram showing the compressed condition of FIG. 2.
Figure 5B:
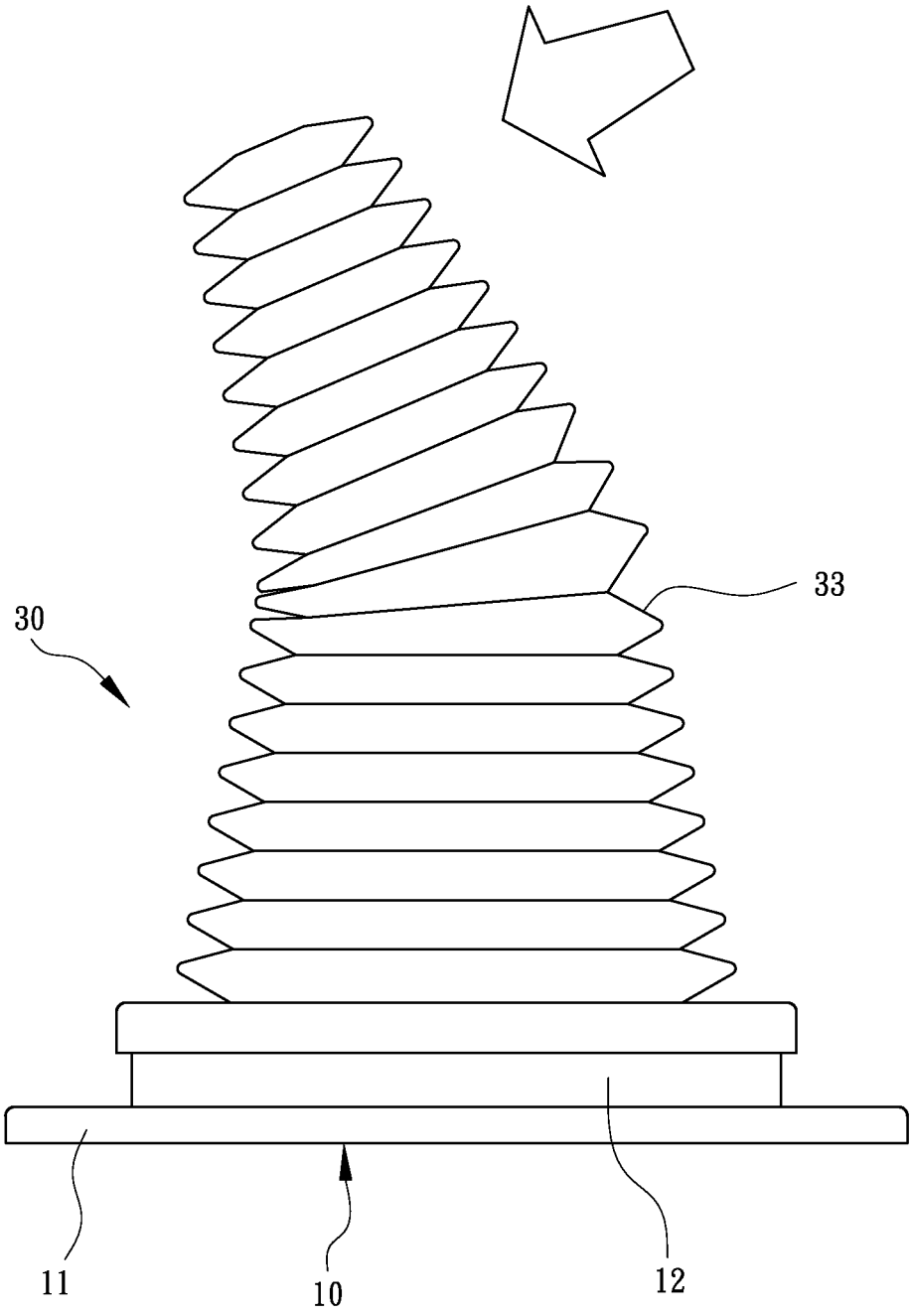
FIG. 5B is a schematic diagram showing distortion on one side under external force of FIG. 2.
Figure 6:
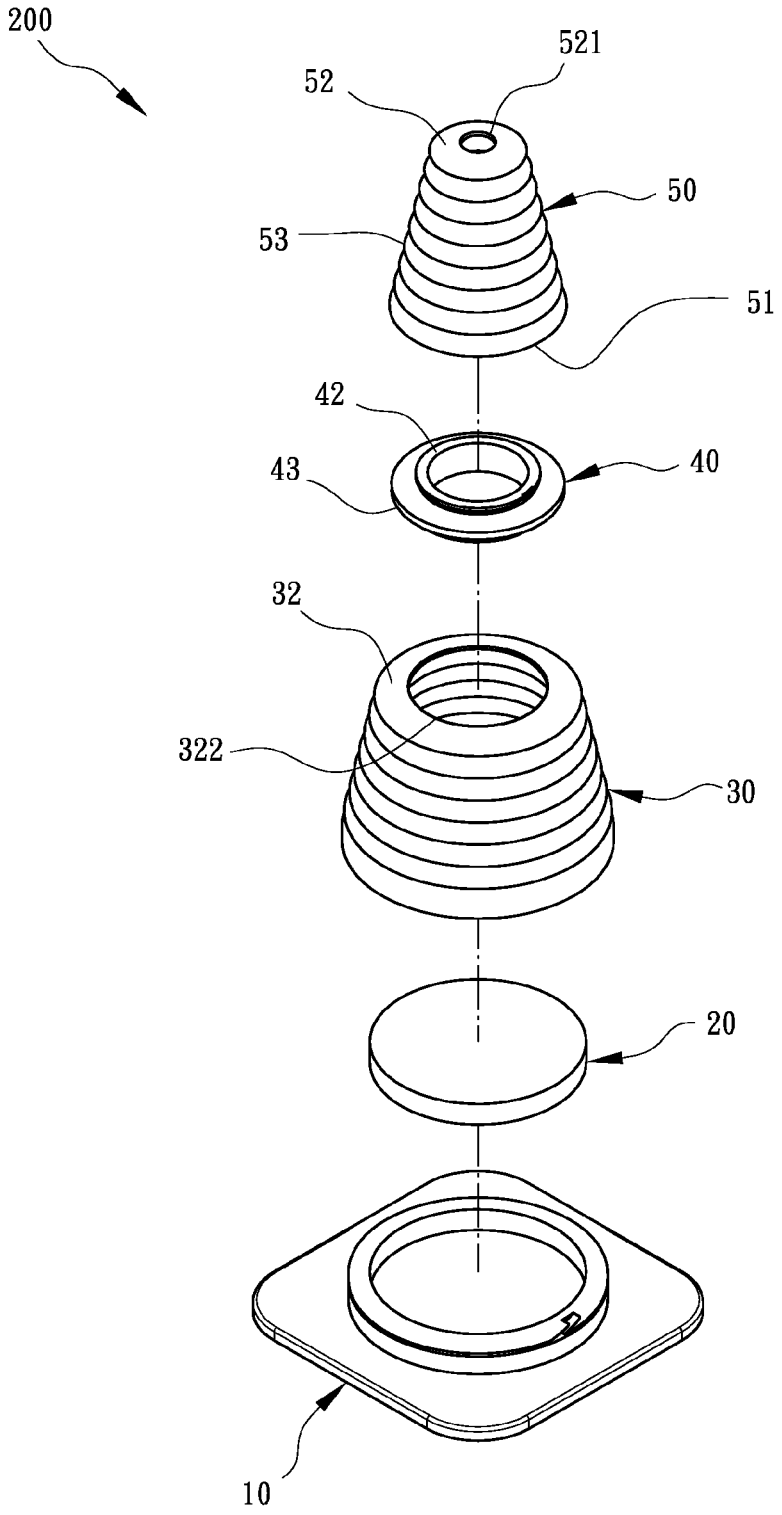
FIG. 6 is an exploded perspective view of a second preferred embodiment of the present invention.
Figure 7:
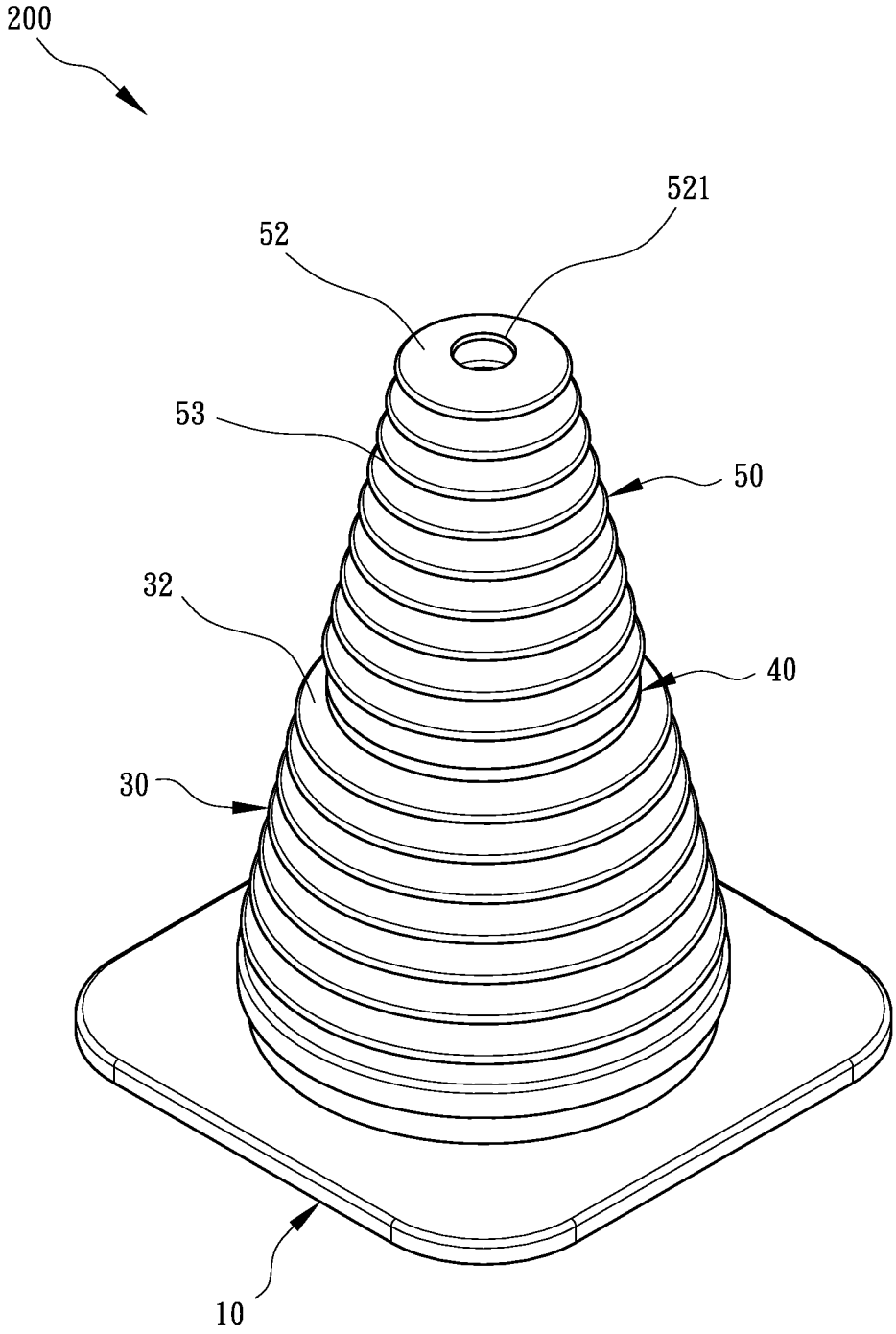
FIG. 7 is a three-dimensional assembly diagram of FIG. 6.

Since the telescopic warning body 30 has a flexible bellows-shaped tube, when storing the safety warning device 100, the user can press the top end 32 to compress the volume of the telescopic warning body 30. The top end 32 will move toward the bottom end 31 to compress the bellows section 33, and the height of the bellows section 33 will decrease (as shown in FIG. 5A), thereby largely reducing the volume of the telescopic warning body 30 and saving storage space, as well as making moving more easy. Besides, the telescopic warning body 30 is flexible and can be distorted and restored to the original shape under an external force (as shown in FIG. 5B). Thus, the telescopic warning body 30 is not easy to get damaged when being hit, which can further prolong the usage life. Due to the flexible characteristic, the telescopic warning body 30 can minimize the damage and injury of the vehicles and the pedestrians when the vehicles or the pedestrians hit the telescopic warning body 30, thereby achieving the goals of small storage volume, easy moving, long usage life, and superior safety. Moreover, because of having the features of being able to be compressed under force, lateral side distortion and restoration ability, the telescopic warning body 30 can be used in the in-line skates, skateboard, or other exercises to prevent the user from being injured.

Besides, a reflective layer (not shown in the FIGS.) can be applied to the outer periphery of the bellows section 33 of the telescopic warning body 30. The reflective layer can be a reflective paint or a reflective sticker, which can enhance the recognition and provide safer warning effect.

Figure 11:
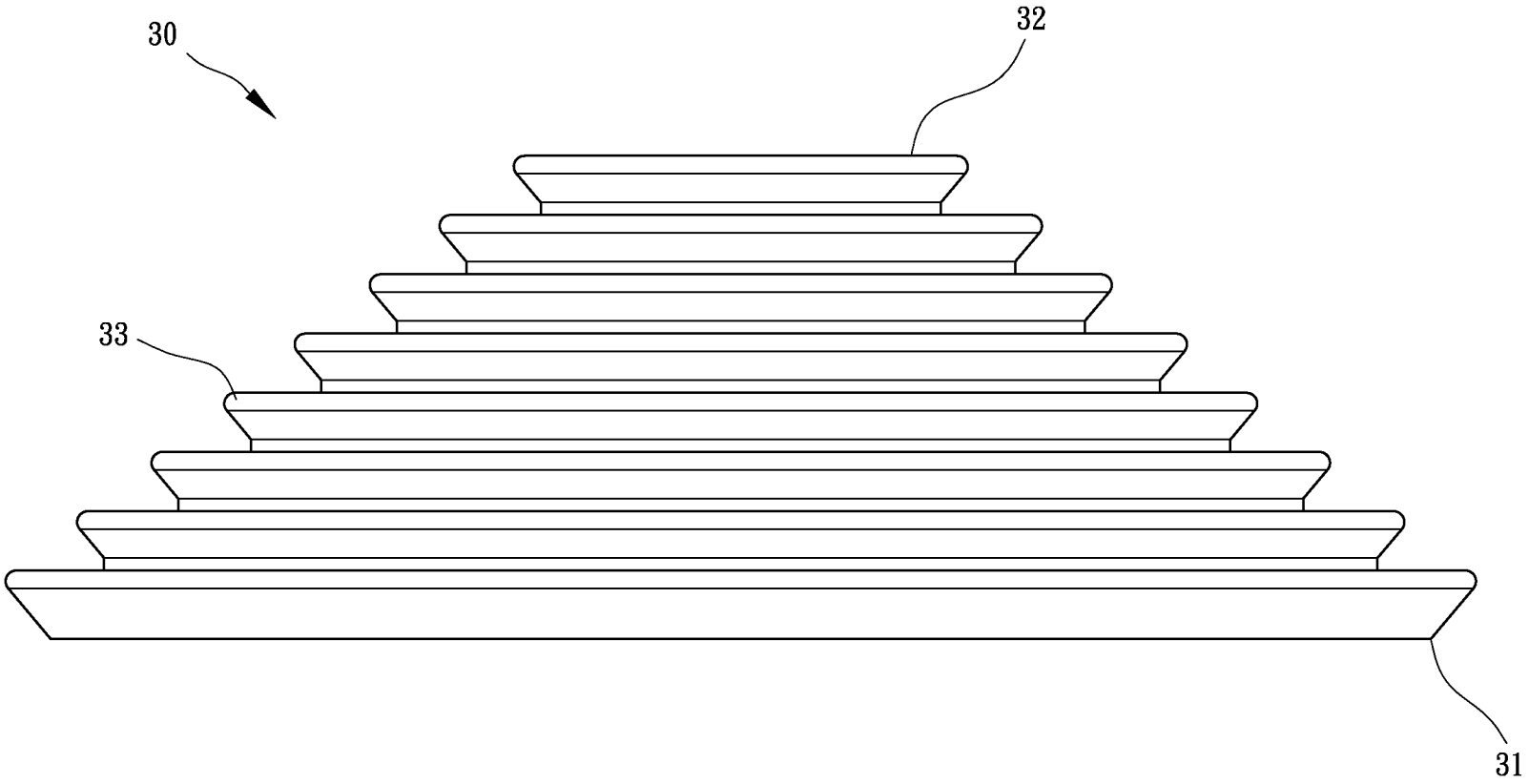
FIG. 11 is a front view of the telescopic warning body of a preferred embodiment of the present invention.

The FIG. 11 provides a front view of the telescopic warning body 30 of the preferred embodiment of the present invention. The structure and function of the telescopic warning body 30 as shown in FIG. 11 is the same as the previous embodiment. The differences lie in that the outer shape and size. The embodiment shown in FIG. 11 is a flatter type of telescopic warning body 30.

Figure 10:
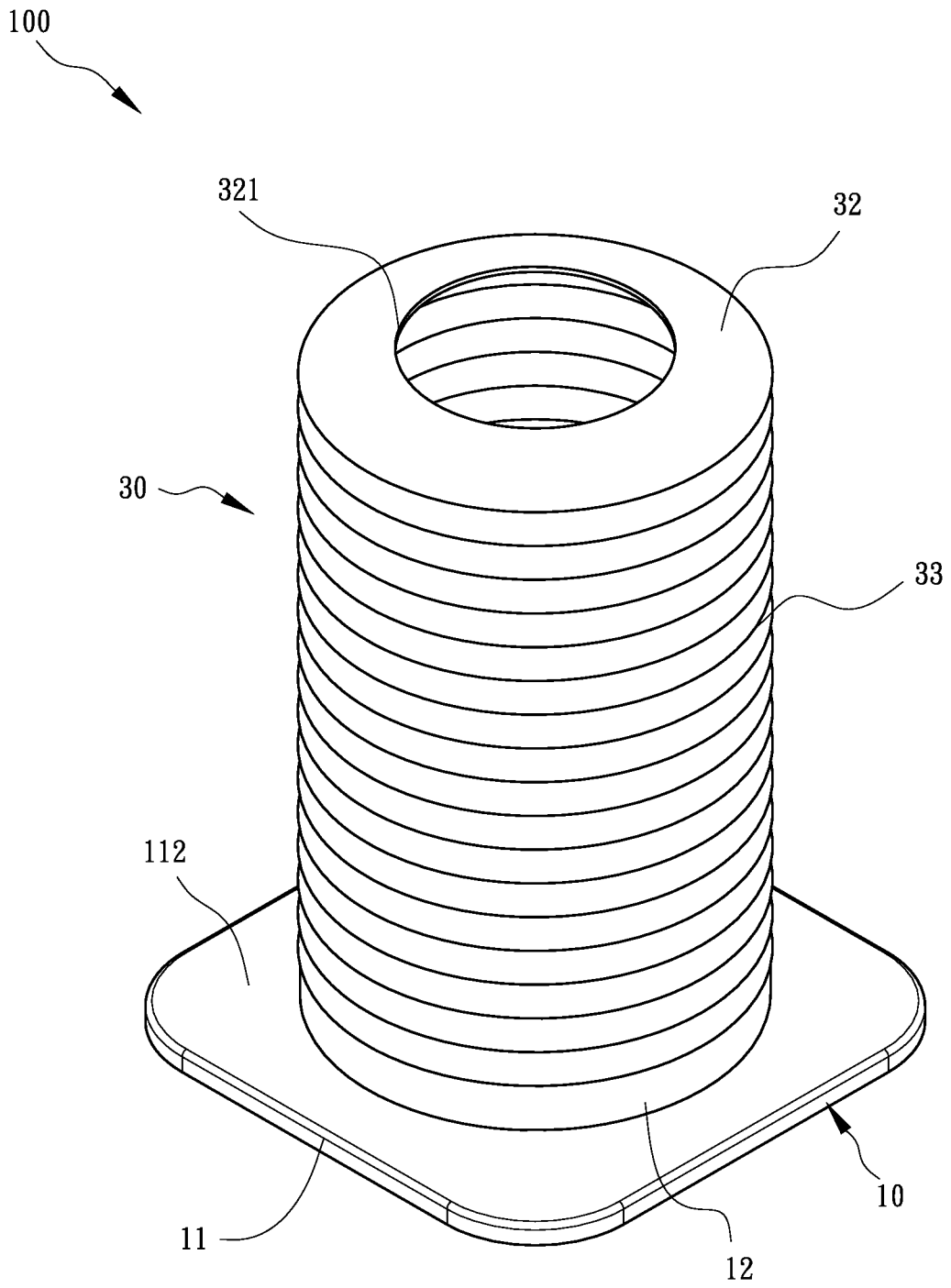
FIG. 10 is a three-dimensional assembly diagram of another preferred embodiment of the present invention.

Moreover, even though the telescopic warning body 30 in the previous embodiment is formed as conical shape, the telescopic warning body 30 can also form as other shapes, such as cylindrical shape (as shown in FIG. 10), which means the outer diameter of the bottom end is identical to the outer diameter of the top end, and the same compression effect can also be achieved.

Furthermore, even though the telescopic function of the telescopic warning body 30 is achieved by serially connecting multiple unit structures, which means each unit structure at least includes two rings with different diameters and two side walls connecting the two rings, the telescopic function of the telescopic warning body 30 can actually be achieved by utilizing continuous spiral structures, which means two spiral strings with different diameters and a wall provided between the two spiral strings can have the same compression effect. The structure can also be a combination of the aforementioned two structures, which means a combination of a multi-unit structure and a spiral structure.

Please refer to FIGS. 6-9, which is a second preferred embodiment of a safety warning device 200. The safety warning device 200 not only has a base 10, a counterweight block 20, and a telescopic warning body 30 which are the same as the first preferred embodiment, but also includes an elongated connecting ring 40 and an elongated telescopic warning body 50.

The structure of the base 10, the counterweight 20, and the telescopic warning body 30 of the second embodiment is the same as the first embodiment.

Please refer to FIGS. 6-9, the elongated connecting ring 40 is an integrally formed round-shaped ring, which can define a bottom connecting part 41, a top connecting part 42, and a middle connecting part 43 connecting the bottom connecting part 41 and the top connecting part 42. The outer diameter of the middle connecting part is larger than that of the bottom connecting part 41 and the top connecting part 42. An outer periphery of the bottom connecting part 41 is concavely formed with a bottom connecting ring trough 411 and a bottom inserting trough 412 communicating the bottom connecting ring trough 411 and one end of the elongated connecting ring 40. The bottom inserting trough 412 is inclinedly corresponding to an axle of the elongated connecting ring 40. An outer periphery of the top connecting part 42 is concavely formed with a top connecting ring trough 421 and a top inserting trough 422 communicating the top connecting ring trough 421 and another end of the elongated connecting ring 40. The top inserting trough 422 is inclinedly corresponding to an axle of the elongated connecting ring 40.

Please refer to FIGS. 6-9, the elongated telescopic warning body 50 is integrally formed as a flexible bellows-shaped tube, which is in conical shape. The elongated telescopic warning body 50 has an elongated bottom end 51, an elongated top end 52, and an elongated bellows section 53 connected between the elongated bottom end 51 and the elongated top end 52. The outer diameter of the elongated bottom end 51 is larger than that of the elongated top end 52. The outer diameter of the elongated bellows section 53 at the elongated bottom end 51 eventually narrows down toward the elongated top end 52. A bottom connecting flange 511 is formed at the elongated bottom end 51 toward an axle of the elongated telescopic warning body 50. A through hole 521 communicating outside and inside is formed at the center of the elongated top end 52.

Figure 8:
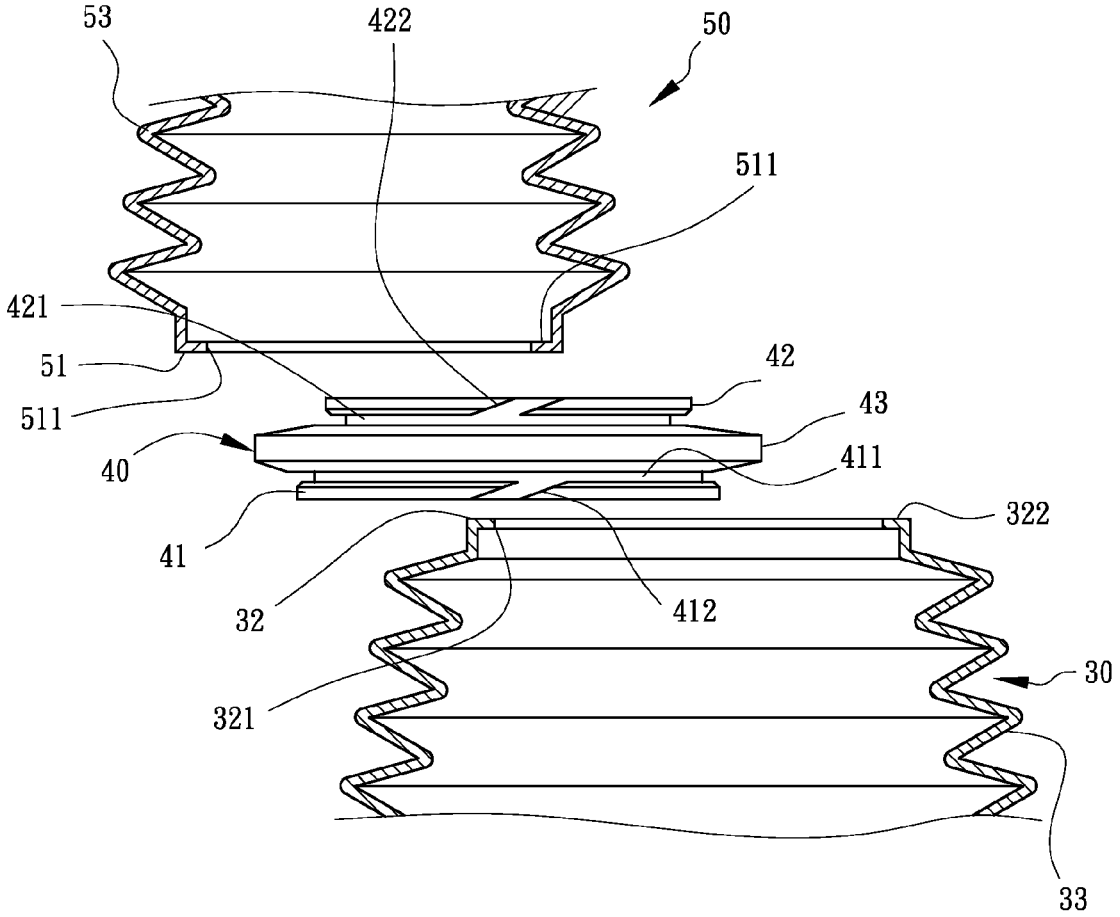
FIG. 8 is a schematic diagram showing the assembling process of FIG. 6.

Please refer to FIG. 8, in the present embodiment, a top connecting flange 322 is formed at the top end 32 toward an axle of the telescopic warning body 30.

The aforementioned is the second preferred embodiment of the safety warning device 200 according to the present invention. The detailed assembling method and the way of using are described below.

Figure 9:
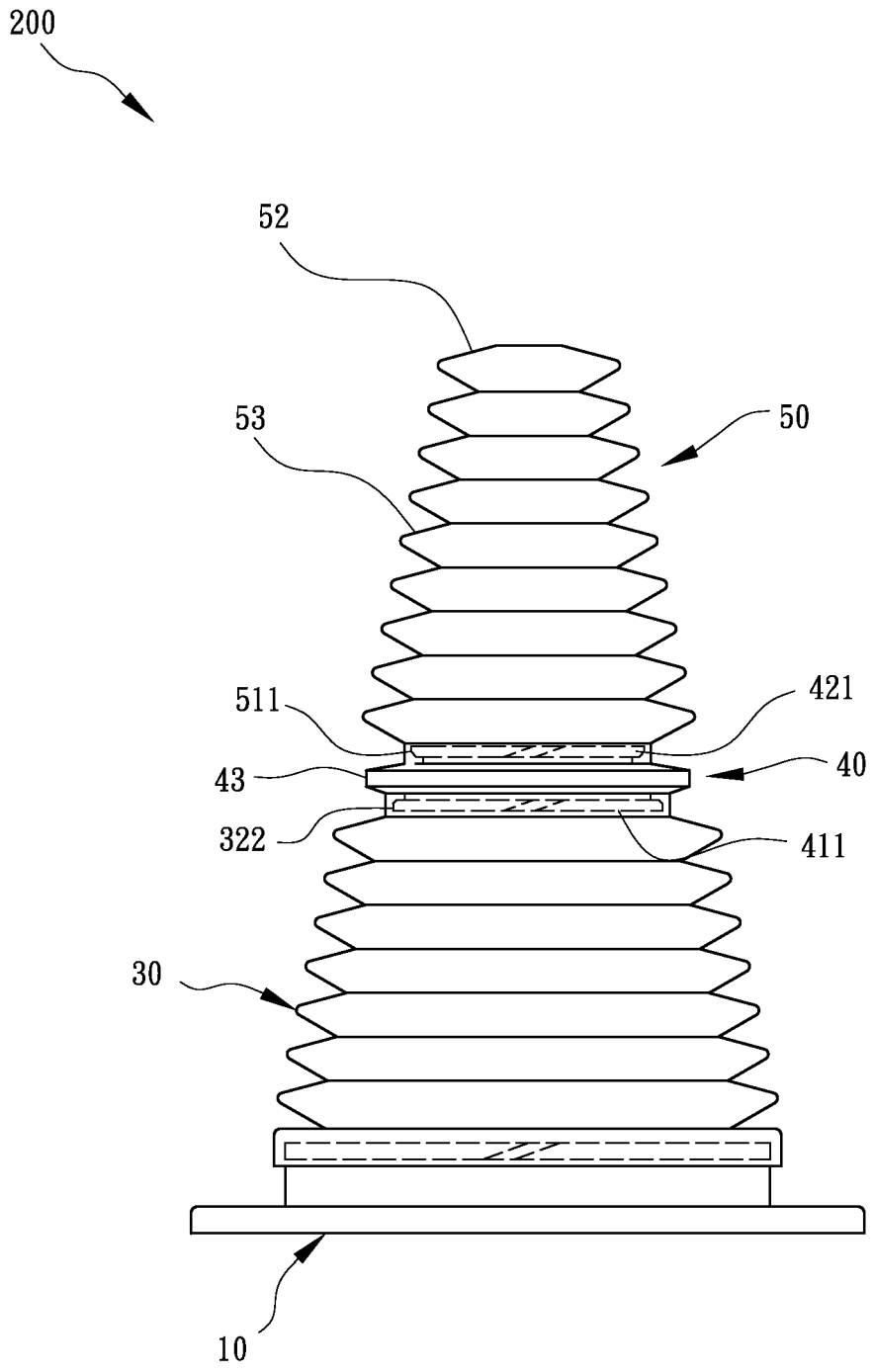
FIG. 9 is an assembled sectional view of FIG. 6.

First, assemble the base 10, the counterweight block 20, and the telescopic warning body 30 in a same manner as the first embodiment. And then, the top connecting flange 322 on the top end 32 of the telescopic warning body 30 slides along the bottom inserting trough 412 of the elongated connecting ring 40 (as shown in FIG. 8) into the bottom connecting ring trough 411 and rotates a circle along the bottom connecting ring trough 411, so as to connect the top connecting flange 322 of the telescopic warning body 30 to the bottom connecting ring trough 411 of the elongated connecting ring 40 (as shown in FIG. 9). The bottom connecting flange 511 on the elongated bottom end 51 of the elongated telescopic warning body 50 slides along the top inserting trough 422 of the elongated connecting ring 40 (as shown in FIG. 8) into the top connecting ring trough 421 and rotates a circle along the top connecting ring trough 421, so as to connect the bottom connecting flange 511 of the elongated telescopic warning body 50 to the top connecting ring trough 421 of the elongated connecting ring 40 (as shown in FIG. 9).

By the aforementioned arrangement, the present embodiment not only has the same function as the previous embodiment, but also extends the height of the safety warning device by combining the telescopic warning body 30, the elongated connecting ring 40, and the elongated telescopic warning body 50, and the diverse application of the safety warning device of the present embodiment can be achieved.

Besides, a reflective layer (not shown in the FIGS.) can be applied to the outer peripheries of the elongated bellows section 53 of the elongated telescopic warning body 50 and the middle connecting part 43 of the elongated connecting ring 40. The reflective layer can be a reflective paint or a reflective sticker, which can enhance the recognition and provide safer warning effect.

Moreover, even though the elongated telescopic warning body 50 in the previous embodiment is formed as conical shape, the elongated telescopic warning body 50 can also form as cylindrical shape, which means the outer diameter of the elongated bottom end is identical to the outer diameter of the elongated top end, and the same compression effect can also be achieved.

Furthermore, even though the telescopic function of the elongated telescopic warning body 50 is achieved by serially connecting multiple unit structures, which means each unit structure at least includes two rings with different diameters and two side walls connecting the two rings, the telescopic function of the elongated telescopic warning body 50 can actually be achieved by utilizing continuous spiral structures, which means two spiral strings with different diameters and a wall provided between the two spiral strings can also have the same compression effect. The structure can also be a combination of the aforementioned two structures, which means a combination of a multi-unit structure and a spiral structure.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A safety warning device, comprising:

a telescopic warning body integrally formed with a flexible bellows-shaped tube, the flexible bellows-shaped tube having a bottom end, a top end, and a bellows section connected between the bottom end and the top end; thus, the telescopic warning body being able to be compressed and elongated under external force;

a base, having a base plate and a connecting ring seat, the base plate having a bottom surface and a top surface being on an opposite side of the bottom surface, the connecting ring seat being integrally connected to the top surface of the base plate; a connecting flange being formed at the bottom end toward an axle of the telescopic warning body, an outer periphery of the connecting ring seat concavely forming a connecting ring trough and an inserting trough communicating the connecting ring trough and a top surface of the connecting ring seat, the inserting trough inclinedly corresponding to an axle of the connecting ring seat, the connecting flange of the telescopic warning body sliding along the inserting trough of the base to slide into the connecting ring trough and rotating a circle around the connecting ring trough, so as to engage the connecting flange of the telescopic warning body in the connecting ring trough of the base; and an elongated telescopic warning body and an elongated connecting ring connected between the telescopic warning body and the elongated telescopic warning body, an outer periphery of the elongated connecting ring concavely forming a bottom connecting ring trough, a bottom inserting trough communicating the bottom connecting ring trough and one end of the elongated connecting ring, the outer periphery of the elongated connecting ring also concavely forming a top connecting ring trough and a top inserting trough communicating the top connecting ring trough and another end of the elongated connecting ring, the bottom inserting trough inclinedly corresponding to an axle of the elongated connecting ring, the top inserting trough inclinedly corresponding to the axle of the elongated connecting ring, the elongated telescopic warning body integrally formed as the flexible bellows-shaped tube, the elongated flexible bellows-shaped tube having an elongated bottom end, an elongated top end, and an elongated bellows section connected between the elongated bottom end and the elongated top end, a bottom connecting flange being formed at the elongated bottom end toward an axle of the elongated telescopic warning body, a top connecting flange being formed at the elongated top end toward the axle of the telescopic warning body, the top connecting flange of the telescopic warning body sliding along the bottom inserting trough of the elongated connecting ring and sliding into the bottom connecting ring trough to rotate a circle along the bottom connecting ring trough, so as to engage the top connecting flange of the telescopic warning body in the bottom connecting ring trough of the elongated connecting ring, the bottom connecting flange of the elongated telescopic warning body sliding along the top inserting trough of the elongated connecting ring and sliding into the top connecting ring trough to rotate a circle along the top connecting ring trough, so as to engage the bottom connecting flange of the elongated telescopic warning body in the top connecting ring trough of the elongated connecting ring.

2. The safety warning device according to claim 1, wherein the telescopic warning body is formed as conical shape, an outer diameter of the bottom end is larger than that of the top end; an outer diameter of the bellows section at the bottom end eventually narrows down toward the top end.

3. The safety warning device according to claim 1, wherein the telescopic warning body is formed as cylindrical shape, an outer diameter of the bottom end and the top end are of same size.

4. The safety warning device according to claim 1, wherein a center of the top end of the telescopic warning body forms a through hole communicating inside and outside of the telescopic warning body.

5. The safety warning device according to claim 1 further comprising a counterweight block; an accommodating space with an hollow top being formed by surrounding of the connecting ring seat and the top surface of the base plate, and the counterweight block being accommodated in the accommodating space.

6. The safety warning device according to claim 1, wherein the elongated connecting ring is integrally formed and has a bottom connecting part, a top connecting part, and a middle connecting part connecting the bottom connecting part and the top connecting part; an outer diameter of the middle connecting part is larger than that of the bottom connecting part and the top connecting part; the bottom connecting ring trough and the bottom inserting trough are formed on an outer peripheral surface of the bottom connecting part; the top connecting ring trough and the top inserting trough are formed on an outer peripheral surface of the top connecting part.

7. The safety warning device according to claim 1, wherein the elongated telescopic warning body is formed as conical shape; an outer diameter of the elongated bottom end is larger than that of the elongated top end; an outer diameter of the elongated bellows section eventually narrows down from the connecting position of elongated bottom end toward the elongated top end.

8. The safety warning device according to claim 1, wherein the elongated telescopic warning body is formed as cylindrical shape; the outer diameter of the elongated bottom end is equal to that of the elongated top end.

* * * * *